US007883429B1

(12) United States Patent
Chen

(10) Patent No.: US 7,883,429 B1
(45) Date of Patent: Feb. 8, 2011

(54) GOLF PUTTING AND SHORT-SWING TRAINING DEVICE

(76) Inventor: Yung-Shen Chen, 2F., 93, Alley 186, Lane 75, Sec. 3, Kang Ning Rd., Nei Hu District, Taipei (TW)

( * ) Notice: Subject to any disclaimer, the term of this patent is extended or adjusted under 35 U.S.C. 154(b) by 0 days.

(21) Appl. No.: 12/722,815

(22) Filed: Mar. 12, 2010

(51) Int. Cl.
*A63B 69/36* (2006.01)

(52) U.S. Cl. ..... 473/258; 473/229

(58) Field of Classification Search ..... 473/226, 473/229, 257, 258, 259, 260, 261
See application file for complete search history.

(56) References Cited

U.S. PATENT DOCUMENTS 2,776,836 A * 1/1957 Zadina ..... 473/226
5,026,066 A * 6/1991 Kane ..... 473/227
5,467,993 A * 11/1995 Higginson ..... 473/229
5,658,204 A * 8/1997 Nappi ..... 473/229
5,895,327 A * 4/1999 Francisco ..... 473/229
6,364,786 B1 * 4/2002 Khano ..... 473/257
6,551,197 B1 * 4/2003 Travo ..... 473/258

* cited by examiner

*Primary Examiner*—Nini Legesse
(74) *Attorney, Agent, or Firm*—Pai Patent & Trademark Law Firm; Chao-Chang David Pai

(57) ABSTRACT

A golf putting and short-swing training device includes an upright support, an extension rod vertically adjustably mounted in the top side of the upright support, a track located on the top side of the extension rod in a laterally tilted manner and having an arched sliding groove rail, a slide coupled to the track and movable along the arched sliding groove, and a supplementary bar fastened to the slide for holding by a player with a golf club to practice putting or short-swing techniques accurately.

14 Claims, 8 Drawing Sheets

GOLF PUTTING AND SHORT-SWING TRAINING DEVICE

BACKGROUND OF THE INVENTION (a) Field of the Invention

The present invention relates to golf training apparatus and more particularly to a golf putting and short-swing training device, which helps a beginner practice putting and short-swing techniques accurately.

(b) Description of the Prior Art

To play the game of golf, one needs to practice club swinging techniques accurately. Repeat simulation-based training enables a beginner to control running or flying of the ball along the expected path within a short time. During practice, a beginner needs to correct the swinging and putting actions properly in order to develop an accurate swinging posture. However, a beginner may practice putting or swing techniques on the green, fairway, bunker or any other places, the swinging action or posture will be adjusted accordingly. A beginner may be unable to identify the mistake and can perform the techniques accurately only after a long time of practice.

SUMMARY OF THE INVENTION

The present invention has been accomplished under the circumstances in view. It is therefore the main object of the present invention to provide a golf putting and short-swing training device, which uses a slide to move back and forth along a smoothly arched sliding groove on a track to guide a user to swing a golf club, so that the user can practice putting and short-swing techniques accurately.

It is another object of the present invention to provide a golf putting and short-swing training device, which uses an upright support and an extension rod to support the track and the slide so that every user can adjust the elevation of the track and the slide according to individual body height.

It is still another object of the present invention to provide a golf putting and short-swing training device, which keeps the track laterally tilted relative to the extension rod and the upright support and has the smoothly arched sliding groove curved upwards from the middle toward the two distal ends thereof, so that a user can practice putting and short-swing techniques accurately.

DETAILED DESCRIPTION OF THE PREFERRED EMBODIMENTS

Figure 1:
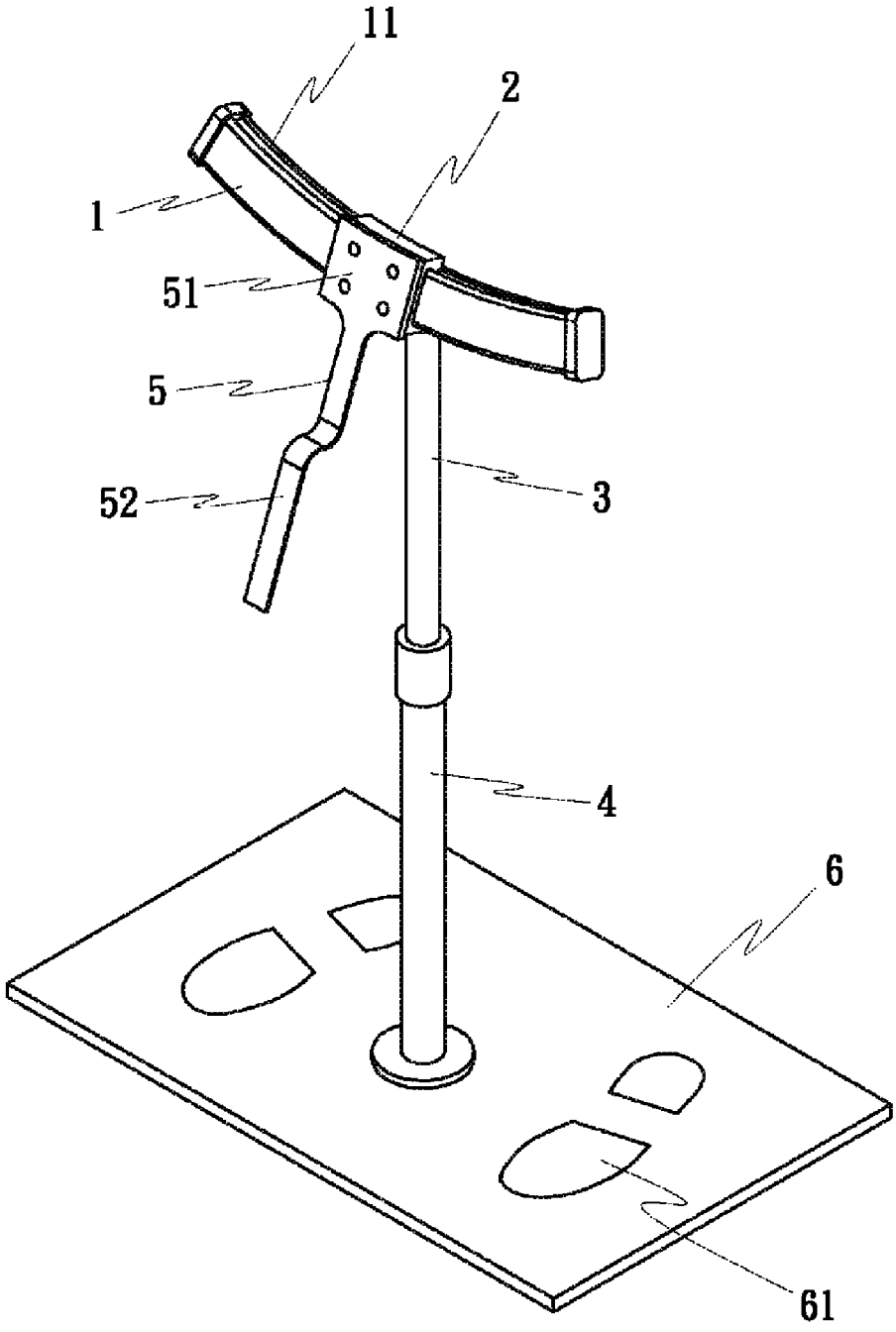
FIG. 1 is an elevational view of a golf putting and short-swing training device in accordance with the present invention.

As shown in FIGS. 1~6, a golf putting and short-swing training device in accordance with the present invention comprises a track 1, a slide 2, an extension rod 3, an upright support 4, and a supplementary bar 5.

Figure 4:
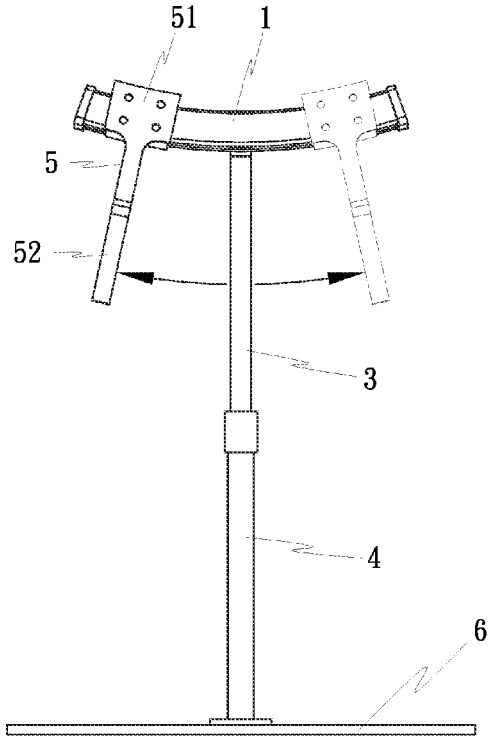
FIG. 4 is a front view of the golf putting and short-swing training device in accordance with the present invention.
Figure 5:
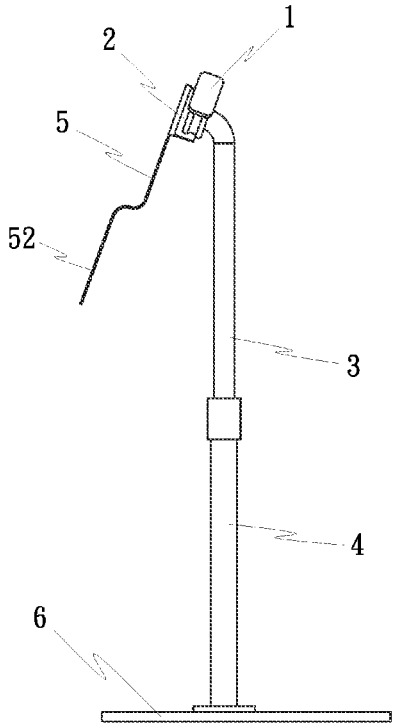
FIG. 5 is a side view of the golf putting and short-swing training device in accordance with the present invention.
Figure 6:
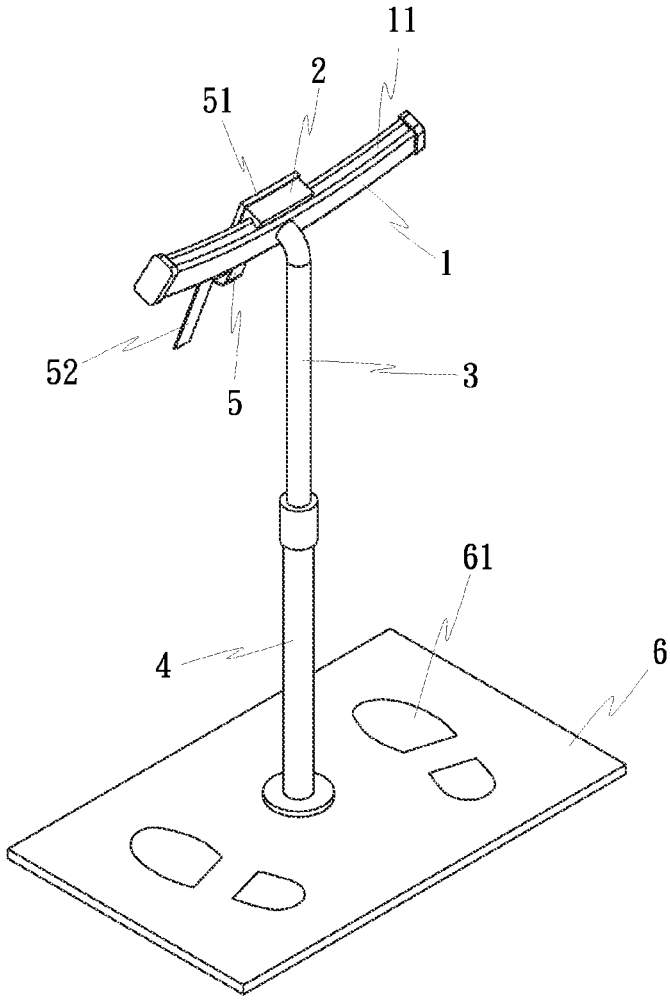
FIG. 6 corresponds to FIG. 1 when viewed from another angle.

The track 1 is a rail member fixedly mounted on the top end of the extension rod 3, having a smoothly arched sliding groove 11 extending along the smoothly arched top wall between two closed ends thereof for guiding sliding movement of the slide 2 relative to the track 1 (see FIG. 4). Further, the track 1 is tilted laterally relative to the extension rod 3 (see FIG. 5). Further, the track 1 can be shaped like a smoothly arched bar. According to the present preferred embodiment, the track 1 curves smoothly upwards from the middle toward the two closed ends.

Figure 2:
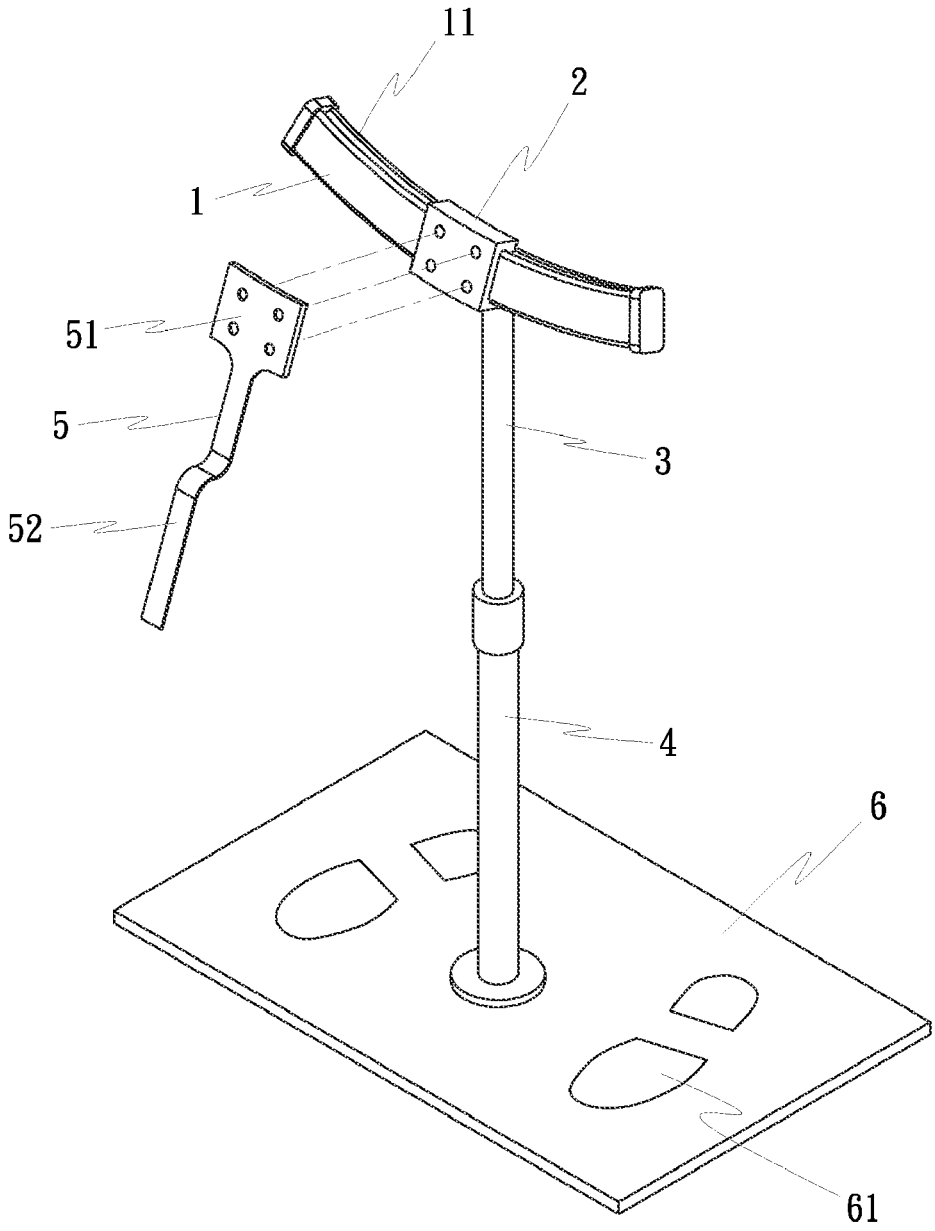
FIG. 2 is an exploded view of the golf putting and short-swing training device in accordance with the present invention.
Figure 3:
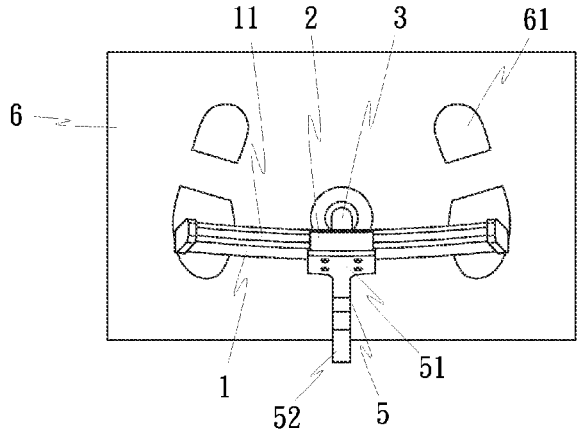
FIG. 3 is a top view of the golf putting and short-swing training device in accordance with the present invention.
Figure 7:
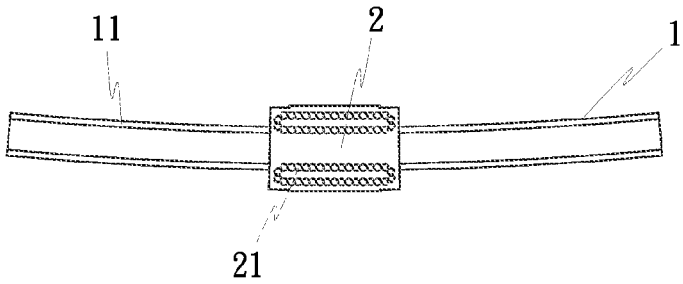
FIG. 7 is a schematic sectional view of a part of the present invention, showing the coupling structure between the track and the slide.
Figure 8:
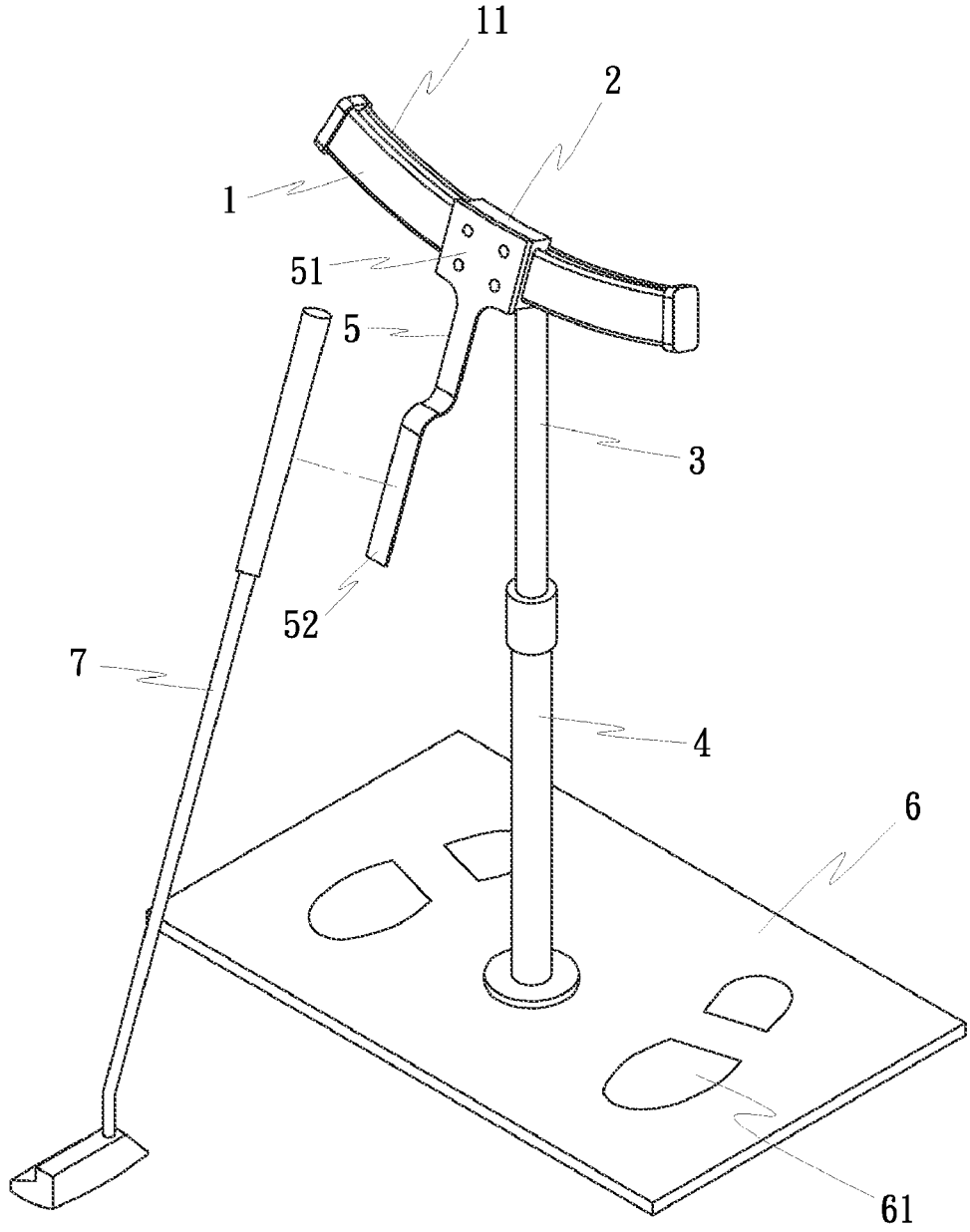
FIG. 8 is a schematic drawing of the present invention before attachment of a golf club to the bearing extension of the supplementary bar.

The slide 2, as shown in FIG. 2, is coupled to the track 1 and movable back and forth along the smoothly arched sliding groove 11. The coupling structure between the slide 2 and the track 1 may be variously embodied. According to the present preferred embodiment, the slide 2 and the track 1 constitute a linear guideway structure. For example, linear ball bearings 21 are provided between the slide 2 and the track 1 to guide the sliding movement of the slide 2 relative to the track 1 (see FIG. 7).

The extension rod 3 has its top end fixedly connected to a middle part of the track 1 and its bottom end inserted into the upright support 4. Preferably, the extension rod 3 can be moved vertically in and out of the upright support 4, and adjustably locked to the upright support 4 at a desired elevation. Quick release means or lock means may be used for enabling the extension rod 3 to be locked to the track 1 at the selected elevation.

The upright support 4 is adapted for positioning on the floor. According to the present preferred embodiment, a bottom board 6 is fixedly mounted on the bottom side of the upright support 4 for supporting the upright support 4 on a flat surface. The bottom board 6 has two footprints 61 marked on the top wall thereof for reference.

The supplementary bar 5 is affixed to one side of the slide 2 to guide the user to swing a putter. The supplementary bar 5 has a mounting plate 51 located on its one end for fixation to the slide 2, and a bearing extension 52 extending from its other end for the attachment of a golf club (for example, a putter) 7 (see FIG. 7).

Figure 9:
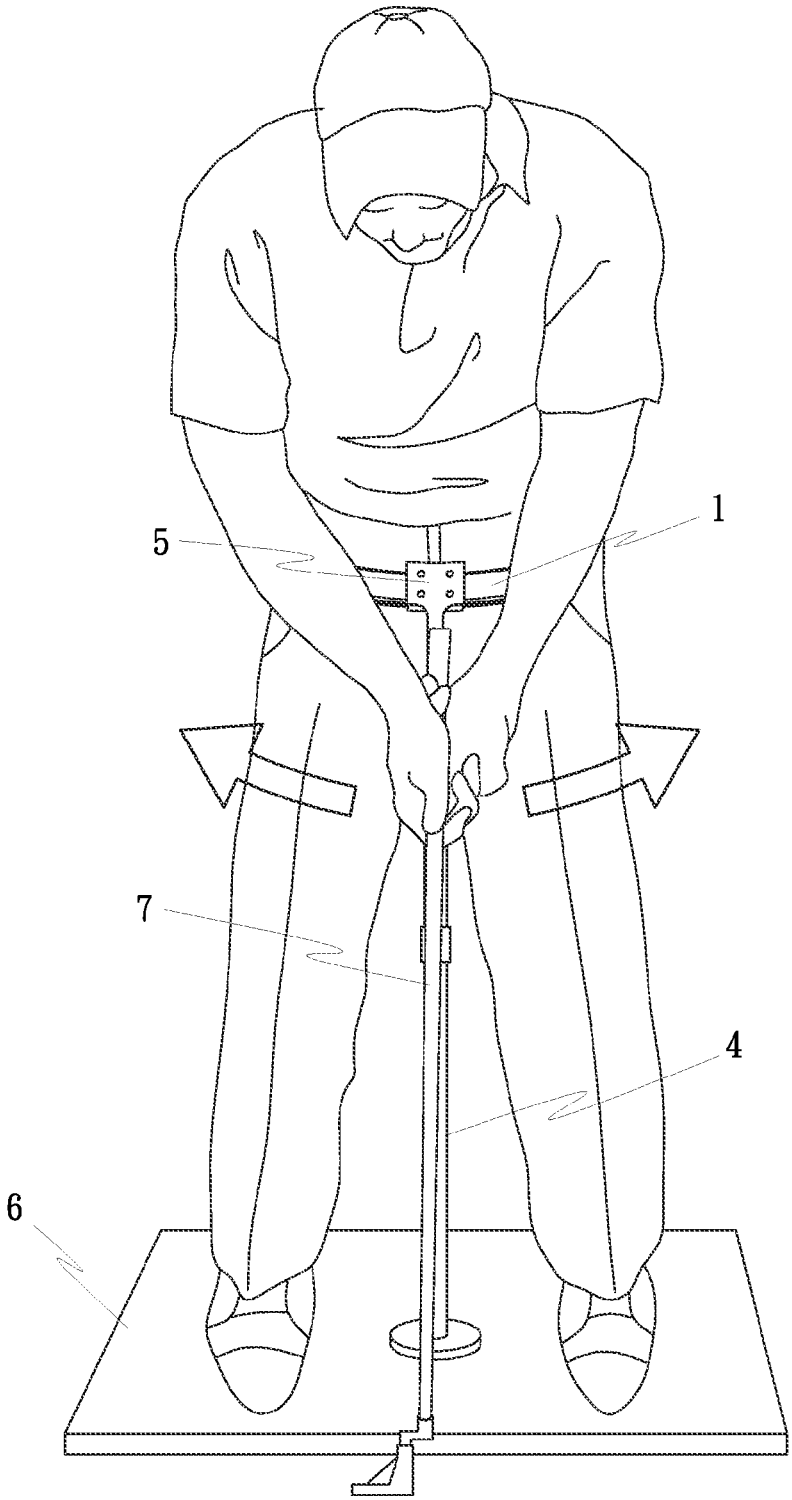
FIG. 9 is a schematic front view, showing an application status of the golf putting and short-swing training device according to the present invention.
Figure 10:
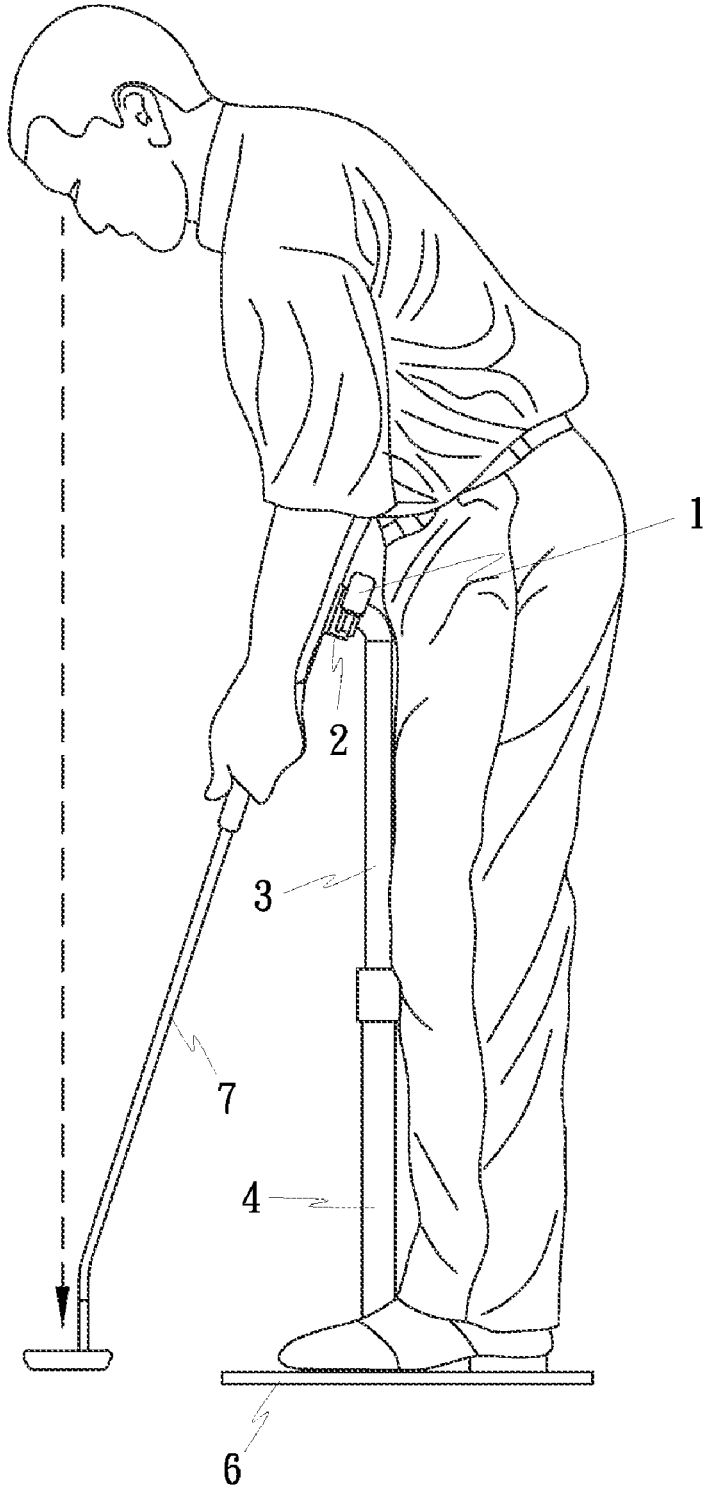
FIG. 10 is a schematic side view, showing an application status of the golf putting and short-swing training device according to the present invention.

After installation of the golf putting and short-swing training device, the slide 2 can be moved back and forth along the smoothly arched sliding groove 11 of the track 1. Thus, the user can attach a golf club (for example, a putter) 7 to the bearing extension 52 of the supplementary bar 5, and then move the golf club 7 and the supplementary bar 5 with the slide 2 relative to the track 2 to practice putting or short-swing techniques. FIGS. 9~10 illustrate the use of the golf putting and short-swing training device to simulate a putting performance.

Further, the length of the smoothly arched sliding groove 11 of the track 1 can be adjusted to fit different training requirements. For practicing putting techniques, the length of the smoothly arched sliding groove 11 of the track 1 can be relatively shorter. For practicing short-swing techniques, the length of the smoothly arched sliding groove 11 of the track 1 must be relatively longer. The configuration of the track 1 shown in the drawings is simply an example of the present invention, but not intended to be a limitation.

As stated above, the track 1 is tilted laterally relative to the extension rod 3. After fixation of the mounting plate 51 of the supplementary bar 5 to the slide 2 at the track 1, the bearing extension 52 of the supplementary bar 5 is kept tilted in one direction (see FIG. 5). When the user attaches a golf club 7 to the bearing extension 52 of the supplementary bar 5 and holds the golf club 7 and the bearing extension 52 with the hands, the golf club 7 is kept at the correct angle (see FIG. 10) for putting or swinging. Further, the track 1 can be affixed to the extension rod 3 without inclination, and the supplementary bar 5 may be curved to keep the bearing extension 52 in a tilted manner for supporting a golf club 7 at the correct angle for practicing putting or swinging techniques.

Further, the supplementary bar 5 and the slide 2 may be made in a single piece. For example, one end of the slide 2 is extended out to form the desired supplementary bar 5 having the desired bearing extension 52.

Figure 11:
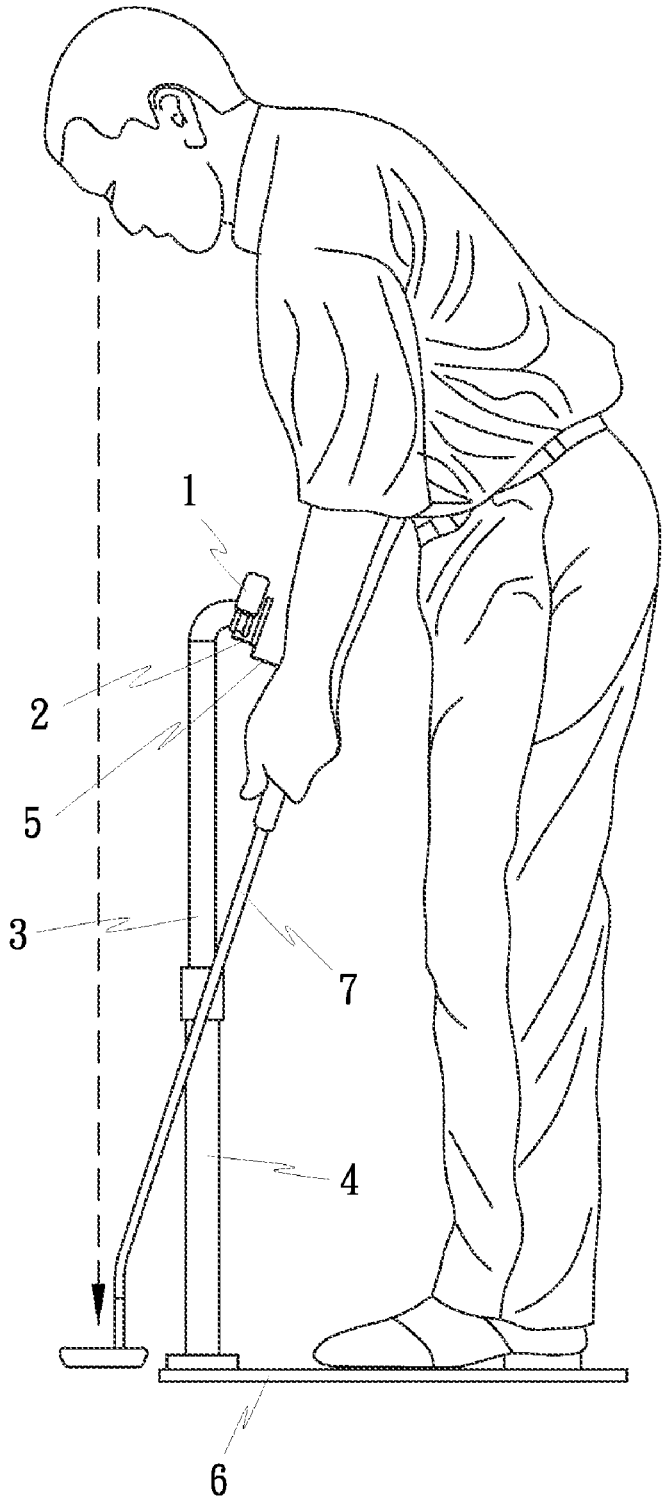
FIG. 11 illustrates an alternate form of the golf putting and short-swing training device in accordance with the present invention.

FIG. 11 illustrates an alternate form of the golf putting and short-swing training device in accordance with the present invention. This alternate form is substantially similar to that shown in FIGS. 1~10 with the exception that the supplementary bar 5 is affixed to the slide 2 at the other side relative to the track 1. Either the supplementary bar 5 is affixed to the slide 2 at the front side relative to the track 1 or at the back side relative to the track 1, the golf putting and short-swing training device achieves the same effects.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A golf putting and short-swing training device, comprising:

an upright support adapted for positioning on a surface;

an extension rod mounted on said upright support, said extension rod having a top end and a bottom end, said bottom end being inserted into said upright support;

a track fixedly mounted on the top end of said extension rod, said track having a smoothly arched sliding groove extending along a smoothly arched top wall thereof;

a slide coupled to said track and movable back and forth along said smoothly arched sliding groove of said track, wherein said track and said slide constitute a linear guideway structure; and a supplementary bar affixed to one side of said slide and movable with said slide along said smoothly arched sliding groove of said track to guide a user to swing a golf club, said supplementary bar having one end thereof affixed to said slide and an opposite end thereof terminating in a bearing extension for supporting a golf club for swinging by a user.

2. The golf putting and short-swing training device as claimed in claim 1, wherein said track is tilted laterally at a predetermined angle relative to said extension rod.

3. The golf putting and short-swing training device as claimed in claim 1, wherein said track curves smoothly upwards from a middle part toward two distal ends thereof.

4. The golf putting and short-swing training device as claimed in claim 1, further comprising a bottom board fixedly mounted on a bottom side of said upright support for supporting said upright support.

5. The golf putting and short-swing training device as claimed in claim 1, wherein said supplementary bar is affixed to said slide at a front side relative to said track.

6. A golf putting and short-swing training device, comprising:

an upright support adapted for positioning on a surface;

an extension rod mounted on said upright support, said extension rod having a top end and a bottom end, said bottom end being inserted into said upright support;

a track fixedly mounted on the top end of said extension rod, said track having a smoothly arched sliding groove extending along a smoothly arched top wall thereof;

a slide coupled to said track and movable back and forth along said smoothly arched sliding groove of said track; and a supplementary bar affixed to one side of said slide and movable with said slide along said smoothly arched sliding groove of said track to guide a user to swing a golf club, said supplementary bar having one end thereof affixed to said slide and an opposite end thereof terminating in a bearing extension for supporting a golf club for swinging by a user, wherein said supplementary bar and said slide are made in a single piece.

7. The golf putting and short-swing training device as claimed in claim 6, wherein said track is tilted laterally at a predetermined angle relative to said extension rod.

8. The golf putting and short-swing training device as claimed in claim 6, wherein said track curves smoothly upwards from a middle part toward two distal ends thereof.

9. The golf putting and short-swing training device as claimed in claim 6, further comprising a bottom board fixedly mounted on a bottom side of said upright support for supporting said upright support.

10. The golf putting and short-swing training device as claimed in claim 6, wherein said supplementary bar is affixed to said slide at a front side relative to said track.

11. A golf putting and short-swing training device, comprising:

an upright support adapted for positioning on a surface;

an extension rod mounted on said upright support, said extension rod having a top end and a bottom end, said bottom end being inserted into said upright support;

a track fixedly mounted on the top end of said extension rod, said track having a smoothly arched sliding groove extending along a smoothly arched top wall thereof;

a slide coupled to said track and movable back and forth along said smoothly arched sliding groove of said track; and a supplementary bar affixed to said slide at a back side relative to said track and movable with said slide along said smoothly arched sliding groove of said track to guide a user to swing a golf club, said supplementary bar having one end thereof affixed to said slide and an opposite end thereof terminating in a bearing extension for supporting a golf club for swinging by a user.

12. The golf putting and short-swing training device as claimed in claim 11, wherein said track is tilted laterally at a predetermined angle relative to said extension rod.

13. The golf putting and short-swing training device as claimed in claim 11, wherein said track curves smoothly upwards from a middle part toward two distal ends thereof.

14. The golf putting and short-swing training device as claimed in claim 11, further comprising a bottom board fixedly mounted on a bottom side of said upright support for supporting said upright support.

* * * * *